US005417364A

United States Patent [19]

Shaw

[11] Patent Number: 5,417,364

[45] Date of Patent: May 23, 1995

[54] KETCHUP POCKET BASKET

[76] Inventor: Loretta A. Shaw, 1866 N. 450 W., Rushville, Ind. 47173

[21] Appl. No.: 272,932

[22] Filed: Jul. 11, 1994

[51] Int. Cl.[6] ..... B65D 3/28

[52] U.S. Cl. ..... 229/400; 229/904; 229/120.02

[58] Field of Search ..... 229/1.58, 1.5 C, 1.5 H, 229/902, 904, 120.02, 120.38

[56] References Cited

U.S. PATENT DOCUMENTS

| | | | |
|---|---|---|---|
| 2,646,200 | 7/1953 | Atkins | 229/1.5 B |
| 2,967,609 | 1/1961 | Gabbard | 229/1.5 B X |
| 3,051,365 | 8/1962 | Sayford, Jr. | 229/1.5 B |
| 3,442,435 | 5/1969 | Ludder et al. | 229/904 X |
| 4,126,261 | 11/1978 | Cook | 229/904 X |
| 4,130,237 | 12/1978 | Struble | 229/122 X |
| 4,183,444 | 1/1980 | English et al. | 229/904 X |
| 4,752,029 | 6/1988 | Buford | 229/122.1 |
| 4,955,528 | 9/1990 | Schluckebier | 229/15 B X |
| 5,137,210 | 8/1992 | Hibbs | 229/1.5 B X |

FOREIGN PATENT DOCUMENTS

| | | | |
|---|---|---|---|
| 642389 | 10/1993 | Australia | 229/904 |

*Primary Examiner*—Allan N. Shoap
*Assistant Examiner*—Christopher J. McDonald
*Attorney, Agent, or Firm*—Robert A. Spray

[57] ABSTRACT

A double basket providing separate containers for a primary substance (e.g., French fries) and an associated condiment substance (e.g., catsup in a cup). The secondary basket has a small auxiliary wall supported by the principle basket's wall panel for juxtaposition along the primary basket's wall panel, but movable to a basket-open position away from that closed position. The auxiliary wall and its support arms provide, nevertheless, that in the closed-pocket condition the pocket components pose significantly no deterrence to what is provided to be a "nestable" stackable feature of a plurality of baskets.

23 Claims, 2 Drawing Sheets

KETCHUP POCKET BASKET

FIELD AND BACKGROUND OF THE INVENTION

The present invention relates to container baskets, and more particularly for snackfood use in which a primary substance, such as French fried potato strips, are dispensed with an associated secondary substance such as a portion of catsup as a condiment.

Still more particularly, the present invention relates to a container basket assembly by which the two substances may be dispensed as an associated twosome, unitarily for convenience of carry and use, yet kept separate until each piece of the primary foodstuff is to be used.

PROBLEMS INHERENT AS TO FOODSTUFF CONTAINERS

Snackfood containers, for individual person's use, are typically made from a stiff cardboard, and of a "throw-away" nature; but because of the economical considerations of the "fast food" business, and because of high volume of containers used on a one-time basis, economy of these containers is a significant consideration.

Another significant consideration is the user's needed openness of the top of both containers for ease of the food-dispensing person in filling both containers, and for ease of withdrawal of the potato strips and for access to the condiment supplementation.

In spite of that desire for openness, the usual need for space-conservation in fast-food retail outlets has long dictated that nestible stackability of many of the food outlet's consumables is an indispensible need, and this is a factor needed in spite of inconsistency with other needs.

Easy collapsability after use is another desirability for snackfood containers, even though it is also somewhat inconsistent with factors such as a wide or open-top nature.

SUMMARY OF THE INVENTION AND ITS CONCEPTS

In carrying out the invention, there is provided a combination of two baskets of a specialized integration nature, as to their own nature and to their relation to one another.

More particularly, there is provided a primary, desirably quite conventional, basket providing a primary container for a primary substance, particularly French fries in the form of the invention illustrated herein.

With that container, there is provided a secondary basket for an associated condiment substance, particularly catsup as here illustrated, in a small cup.

The primary basket has a generally upright wall, quite conventional except that it carries the secondary basket for the catsup or other condiment substance; and the secondary basket has an auxiliary wall, of quite smaller size than the primary wall, which has special support arm means connected to it.

The support arm means are supported by the primary wall panel, supporting the auxiliary wall in a special manner for special characteristics, and, having no significant weight to sustain, are formed from paper or thin sheet-like plastic or cardboard.

A special factor of the support means is that the secondary basket's auxiliary wall is supported so as to be closely juxtaposed along the primary wall panel; and although the auxiliary wall may be pulled outwardly to open-basket condition, the support is of a nature in which the secondary basket has a collapsed condition of substantially zero extent either inwardly or outwardly of the wall panel, not forcing the auxiliary wall to be at any significant distance from the wall panel, but also is changeable to an extended position permitting the auxiliary wall to move to its basket-forming position.

The support means, moreover, provides side walls for the auxiliary wall, and, of special import, in the closed-pocket condition the pocket poses significantly no deterrence to a stackable nature of a plurality of such baskets.

In one form, the support means is of an accordion-fold nature. In a different but somewhat similar embodiment, the supports are arms which extend through openings extending through the basket's wall panel, with card-like guide means, affixed to the inner face of the primary wall panel, which abut the support arms and push them so as to be generally juxtaposed along the inner face of the primary wall panel, thus posing significantly no deterrence to basket stackability.

PRIOR ART CAPABILITY AND MOTIVATIONS, AS HELPING TO SHOW PATENTABILITY HERE

Even in hindsight consideration of the present invention to determine its inventive and novel nature, it is not only conceded but emphasized that the prior art had many details usable in this invention, but only if the prior art had the guidance of the present concepts of the present invention, details of both capability and motivation.

That is, it is emphasized that the prior art had/or knew several particulars which individually and accumulatively show the non-obviousness of this combination invention. E.g., a. The prior art has long had cardboard or other paper "throwaway" containers for snackfoods, of many shapes and sizes;
b. The prior art knew the advantages of economical production of containers;
c. The prior art has long known that nestable stackability was a useful, much-used, and needed characteristic of various items, and of snackfood containers in particular;
d. The prior art has long known that paper and cardboard can be economically formed into not only containers but structural members for light-weight articles;
e. The prior art has had the knowledge of the typical desire of persons to use catsup or other condiment for fried potatoes or other primary foodstuffs;
f. The prior art has been increasingly aware of the problems inherent as to one-use snackfood containers and their use in fastfood merchandizing;
g. The prior art has surely supposed or known that many customers of French fry and other products would likely bake a bray as an additional "throw away" item, merely as a convenient carrier for an associated cup of catsup; but such incidental and unneeded use of brays has surely been recognized as a waste and cost, both economically and ecologically, and a source of extra throw-away litter;
h. The standardness, simplicity, and similarity of throw-away prior art sacks or baskets has surely given their manufacturers ample incentive to have made modifications for commercial competitiveness in a competitive industry;

i. The prior art has always had sufficient skill to make many types of containers, foldable paper products, and various articles having movable parts, more than ample skill to have achieved the present invention, but only if the concepts and their combination had been conceived;

j. Substantially all of the operational characteristics and advantages of details of the present invention, when considered separately from one another and when considered separately from the present invention's details and non-technical accomplishment of the details, are within the skill of persons of various arts, but only when considered away from the integrated and novel combination of concepts which by their cooperative combination achieves this advantageous invention;

k. The details of the present invention, when considered solely from the standpoint of construction, are exceedingly simple; and the matter of simplicity of construction has long been recognized as indicative of inventive creativity; and l. Similarly, and a long-recognized indication of inventiveness of a novel combination, is the realistic principle that a person of ordinary skill in the art, as illustrated with respect to the claimed combination as differing in the stated respects from the prior art both as to construction and concept, is that the person of ordinary skill in the art is presumed to be one who thinks along the line of conventional wisdom in the art and is not one who undertakes to innovate.

Accordingly, although the prior art has had capability and motivation, amply sufficient to presumably give incentive to the development of movable-part "piggyback" containers according to the present invention, the fact remains that the present invention has awaited the present creativity and inventive discovery of the present inventor. In spite of ample motivation and capability shown by the many illustrations herein, the prior art did not suggest this invention.

SUMMARY OF THE PRIOR ART'S LACK OF SUGGESTIONS OF THE CONCEPTS OF THE INVENTION'S COMBINATION

In spite of all such factors of the prior art, the problem here solved awaited this inventor's present invention's creativity. More particularly as to the novelty here of the invention as considered as a whole, the resume of the prior art uses and needs, helps show its contrast to the present concepts, emphasizes the advantages, novelty, and the inventive significance of the present concepts as are here shown, particularly as to utility, stackability, and economy.

Moreover, prior art articles known to this inventor which could possibly be adapted for this duty, fail to show or suggest the details of the present concepts as a combination; and a realistic consideration of the prior art's differences from the present concepts of the overall combination may more aptly be described as teaching away from the present invention's concepts, in contrast to suggesting them, even as to a hindsight attempt to perceive suggestions from a backword look into the prior art, especially since the prior art has long had much motivation as to details of the present invention and to its provisions.

And the existence of such prior art knowledge and related articles embodying such various features is not only conceded, it is emphasized; for as to the novelty here of the combination, of the invention as considered as a whole, a contrast to the prior art helps also to remind both the great variety of the various prior art articles and needed attempts of improvement, and the advantages and the inventive significance of the present concepts. Thus, as shown herein as a contrast to all the prior art, the inventive significance of the present concepts as a combination is emphasized, and the nature of the concepts and their results can perhaps be easier understood.

Although varieties of prior art are conceded, and ample motivation is shown, and full capability in the prior art is conceded, no prior art shows or suggests details of the overall combination of the present invention, as is the proper and accepted way of considering the inventiveness nature of the concepts.

That is, although the prior art may show an approach to the overall invention, it is determinatively significant that none of the prior art shows the novel and advantageous concepts in combination, which provides the merits of this invention, even though certain details are shown separately from this accomplishment as a combination.

And the prior art's lack of an invention of a "piggyback" container achieving the convenience, stackability, simplicity, and other advantages of the present invention, which are goals only approached by the prior art, must be recognized as being a long-felt need.

Accordingly, the various concepts and components are conceded and emphasized to have been widely known in the prior art as to various devices; nevertheless, the prior art not having had the particular combination of concepts and details as here presented and shown in novel combination different from the prior art and its suggestions, even only a fair amount of realistic humility, to avoid consideration of this invention improperly by hindsight, requires the concepts and achievements here to be realistically viewed as a novel combination, inventive in nature. And especially is this a realistic consideration when viewed from the position of a person of ordinary skill in this art at the time of this invention, and without trying to reconstruct this invention from the prior art without use of hindsight toward particulars not suggested by the prior art.

BRIEF DESCRIPTION OF THE DRAWINGS

The above description of the novel and advantageous invention is of somewhat introductory and generalized form. More particular details, concepts, and features are set forth in the following and more detailed description of illustrative embodiments, taken in conjunction with the accompanying drawings, which are of somewhat schematic and diagrammatic nature, for showing the inventive concepts; and in the drawings:

FIG. 1 is an elevation view;

FIG. 2 is a vertical cross-sectional view;

FIG. 3 is an isometric pictorial view;

FIG. 4 is an elevation view;

FIG. 5 is a vertical cross-sectional view;

FIG. 6 is a horizontal cross-sectional view of the overall basket, with the secondary basket in closed condition; and FIG. 7 is an isometric pictorial view.

DETAILED DESCRIPTION OF PREFERRED EMBODIMENTS

Figure 1:
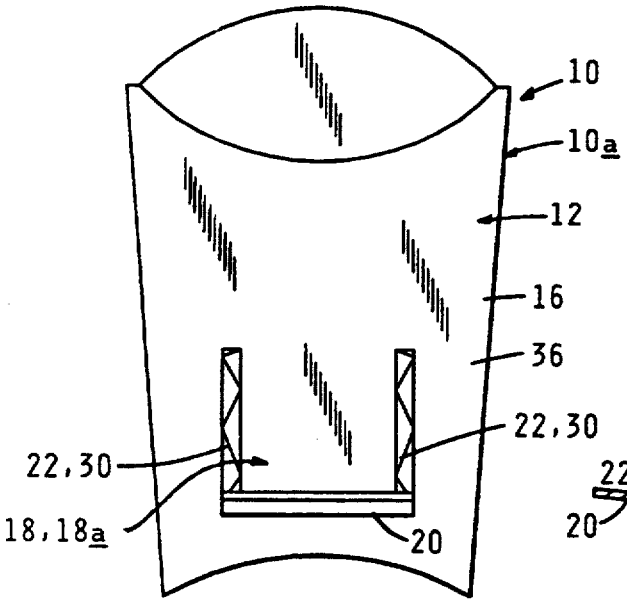
FIGS. 1–3 are views of the overall dual basket of a 1st Embodiment, all three views showing the secondary basket in open or basket-forming condition; and more particularity.

As shown by the embodiments illustrated by the drawings, the invention and its concepts advantageously provide a handy snack basket 10 (10*a*, 1st Embodiment) and 10*b* (2nd Embodiment ), of dual nature, providing a primary container 12 for items particularly such as French fry potatoes as a primary substance, and particularly a secondary basket type container 14 for, e.g., an associated condiment substance such as a cup of catsup 15.

The basket 10, with containers 12/14, gives the user the advantage of integrated convenient carry of associated snack foodstuff items, but achieves the special and seemingly contradictory advantages of full separateness of the containers 12/14 yet has a special "piggyback" nature which permits substantially as good stackability, i.e., nestability characteristics as provided for single or unitary containers; and it has been long known that stackability is a desired advantage for a diversity of many products, and specially for inventory-stocking in busy areas for dispensing snackfood items.

As shown, the basket 10 has a generally upright front wall panel 16, the wall panel 16 providing carry of the secondary container 14, which here is shown as what may be referred to as a secondary basket means 18 (18*a*, 1st Embodiment) and 18*b* (2nd Embodiment ), as a container for the associated catsup or other condiment substance; and it is with respect to the provision of the secondary basket means 18 that the present invention relates.

Figure 2:
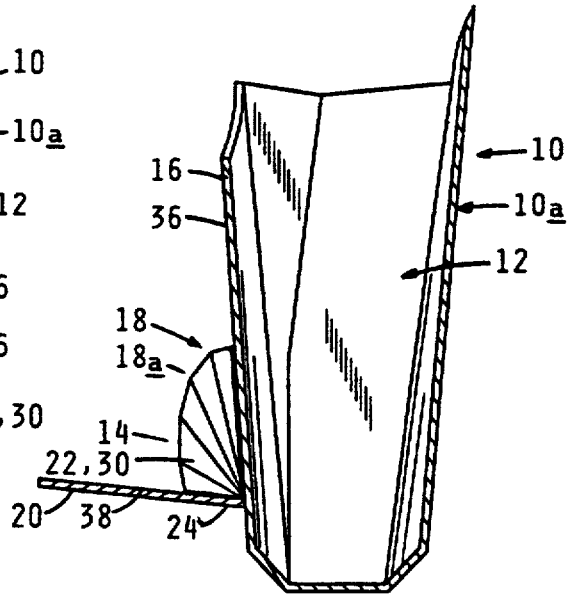
Figure 3:
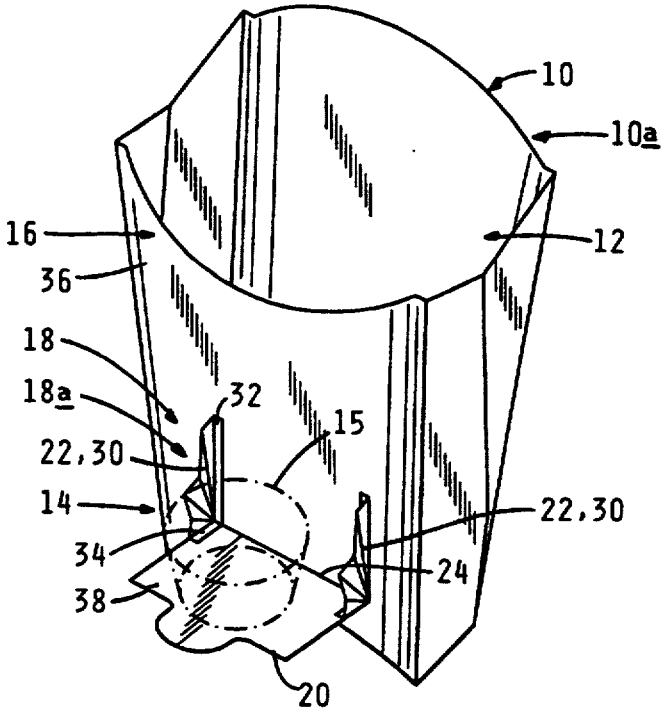
Figure 4:
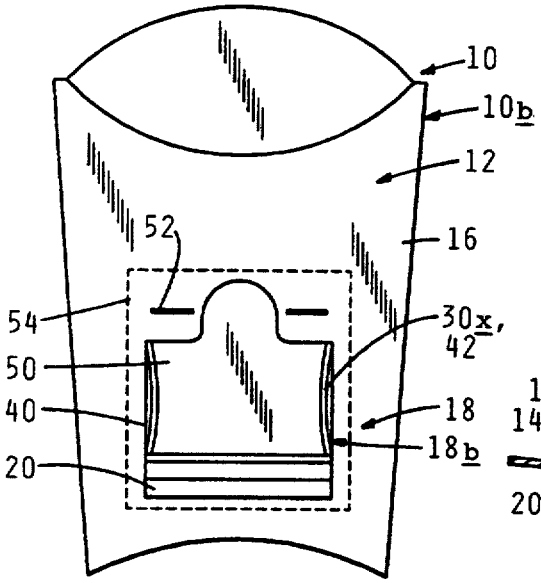
FIGS. 4–7 are views of the overall dual basket of a 2nd Embodiment, with FIGS. 4, 5, and 7 showing the secondary basket in open or basket-forming condition; and more particularly.
Figure 5:
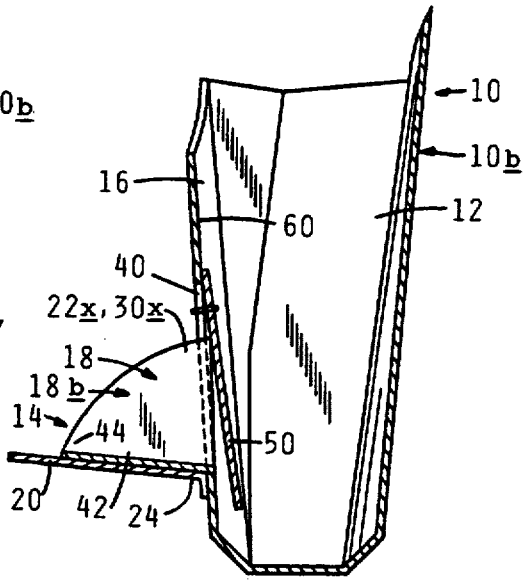
Figure 6:
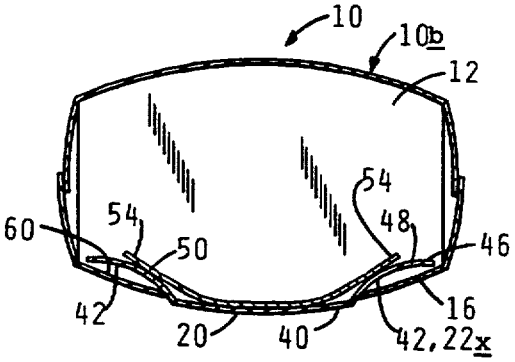
Figure 7:
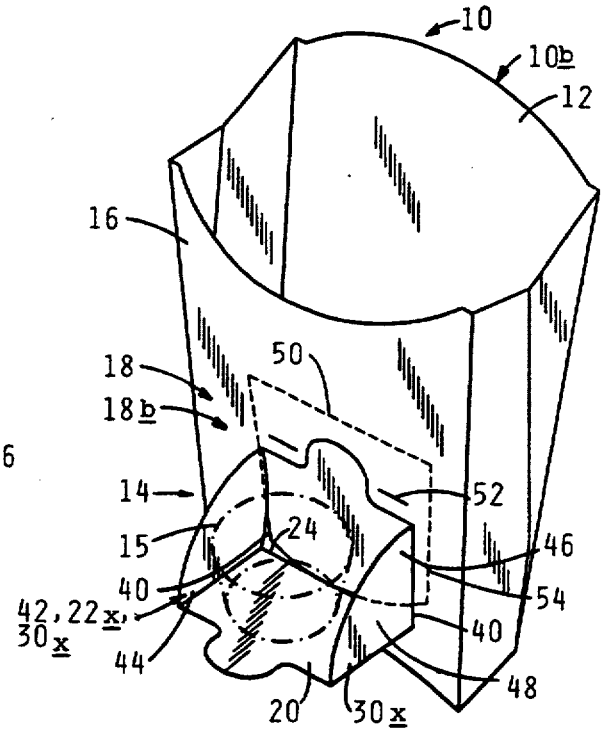

In both embodiments, the secondary basket means 18 is shown as having primary features of an auxiliary wall 20, desirably substantially smaller than the basket container 12's front wall panel 16; and there is provided specialized support means 22 of the 1st Embodiment (FIGS. 1, 2 and 3), which are connected to the auxiliary wall 20, and are themselves supported by the front wall panel 16.

(The support means 22*x* for the 2nd Embodiment (FIGS. 4, 5, 6 and 7) has many of the same characteristics as the support means 22, but with differences as described separately.)

The support means 22 provides support by the front wall panel 16 to the secondary basket 18's auxiliary wall 20 in an especially advantageous manner, i.e., with special characteristics which provide that the auxiliary wall 20 is supported in what may be described as a "first position" in which it is generally juxtaposed, or flatly lying along the front wall panel 16, and provides that the secondary basket 18's auxiliary wall 20 is also supported in what may be described as a "second position" (FIGS. 1–5 and 7), shown as such in the two Embodiments, in which it is in a position away from its panel-juxtaposed first position, a second position in which the auxiliary wall 20 is or approaches horizontal, although as shown the bottom 24 of the auxiliary wall 20 is still relatively adjacent the front wall panel 16.

Of special note for stackability, the support means 22 and 22*x* are of a nature in which they have a collapsed condition of substantially zero extent either inwardly or outwardly of the front wall panel 16, by which the support means 22/22*x* does not force the auxiliary wall panel 20 to be at any significant distance from the front wall panel 16, but also is changeable to an extended position permitting the auxiliary wall 20 to move to its second or basket-forming position, i.e., with the auxiliary wall 20 in its second position providing a support for the container provided for the associated condiment substance cup 15.

For both Embodiments, the support means 22/22*x* has a vertical nature such that when the auxiliary wall 20 is in its second or basket-forming position, the support means 22/22*x* provides side walls 30 (for the 1st Embodiment) or 30*x* (for the 2nd Embodiment), for the region above the auxiliary wall 20.

Also, for both Embodiments, by these concepts, particularly in their combination, the support means 22/22*x* and the auxiliary wall 20 provide the secondary basket means 18 as an operable or cup-holding pocket, a pocket having special characteristics depending upon in which of the conditions or positions the auxiliary wall 20 and the support means 22/22*x* are at the time.

That is, in a first condition, when the auxiliary wall 20 is in its first position, the secondary pocket 18 and its features pose significantly no deterrence to what is provided to be a stackable or nestable feature of a plurality of such baskets; but in the auxiliary wall 20's second position, there is provided the pocket 18 in an open condition for reception of the condiment cup 15.

In the 1st Embodiment, the support means 22 is of an accordion-fold nature, i.e., as shown on both sides a sheet-like body with a series of folds, the fold-sections of the support sheet 22 being folded flat in its first condition. Its respective end-portions 32/34 are fastened as by adhesive substance to the front face 36 of the front wall panel 16 and the rear face 38 of the auxiliary wall 20.

As shown the auxiliary wall 20 is mounted on the basket's wall panel 16 at a low location, substantially spaced from the top thereof; and the support means 22 provides that the top of the auxiliary wall 20, when the auxiliary wall is in its second position, is substantially removed from the basket's wall panel 16, and the auxiliary wall 20 and the exterior pocket means 18 co-operate to provide a substantial seating area for a condiment container.

Now with particular regard to differences of the 2nd Embodiment (FIGS. 4, 5, 6 and 7) from the 1st Embodiment, it is to be noted that the wall panel 16 is provided with a spaced pair of openings 40 extending through the wall panel 16, and the support means 22*x* comprises a spaced pair of support arms 42.

Each of the arms 42 has a relatively outer arm portion 44, a relatively inner arm portion 46, and an intermediate arm portion 48 which extends between them.

The outer arm portions 44 and the intermediate arm portions 48, being portions of the support arms 42 positioned relatively adjacent the sides of the auxiliary wall 20, provide the side walls 30*x*.

The relatively inner portions 46 of the support arms 42 are positioned inwardly of the basket's front wall panel 16, with the intermediate arm portions 48 passing through the respective wall openings 40; and thus regardless of the container basket 14's condition of closed (FIG. 6) or open (FIGS. 4, 5, 7) the inner arm portions 46 are inwardly of the basket wall 16, in the interior of the main or primary container 12.

However, with the basket's wall panel 16 provided with guide means 50, as shown as being a card block 50 stapled by a staple 52 to the wall 16, the block 50 serves to assure nesting or stackability.

That is, even when the auxiliary basket wall 20 is in its closed position (FIG. 6) juxtaposed along the main wall panel 16, the block 50's side edges 54 abut the support arms 42 inner arm portions 46 and adjacent portions of the intermediate arm portions 48, i.e., pushes them such that they are disposed in an "out of the way" condition (FIG. 6) generally juxtaposed along the inner face 60 of the main wall panel 16, thereby posing significantly no deterrence to what is provided by the manufacturer to be a stackable feature of a plurality of such baskets 10.

As shown, the guide block means 50 is provided by a single body member 50 affixed to the inner face of the wall panel 16, providing the guide abutment of both support arms 42, by extending along the wall panel 16 operatively to the location of both of the pair of openings 40 of the wall panel 16; and the block body 50 in the form shown provides a portion of the main or front wall 16.

Friction existing between the side edges 54 and adjacent portions of the guide card 50, against the inner portions 46 of the arm members 42 (22*x*, 30*x*), there being such little weight of the condiment cup 15, is considered sufficient to maintain the open condition of the basket 18*b* without the need of interlock features, although they may be provided if desired.

The nesting stackability of articles of both Embodiments, as provided by a somewhat conical shape of the main container 12, which is already of course provided as a widespread feature of the prior art, is thus advantageously maintained by the two-condition nature of the auxiliary wall 20 and support means 22 (22*x*), a handy and long-usable improvement and modification having many advantages.

SUMMARY OF THE ADVANTAGES

The present invention as detailed herein has advantages in both concept and in component parts and features; for in contrast to other articles known to the inventor as to the prior art mentioned the invention provides advantageous features which should be considered, both as to their individual benefit, and to whatever may be considered to be also their synergistic benefit toward the invention as a whole:

(a) Economy;
(b) Stackability;
(c) Sturdy as to both containers;
(d) Appealing;
(e) Almost spillproof;
(f) Convenient to the dispenser;
(g) Convenient to the user;
(h) Easily collapsable after use; and
(i) Litter minimizing.

CONCLUSION

It is thus seen that a "piggyback" container assembly, constructed and used according to the combination of inventive concepts and details herein set forth, provides novel concepts of a desirable and usefully advantageous article, yielding advantages which are and provide special and particular advantages when used as herein set forth.

In summary as to the nature of the overall article's advantageous concepts, their novelty and inventive nature is shown by novel features of concept and construction shown here in advantageous combination and by the novel concepts hereof not only being different from all the prior art known, even though snackfood and other throwaway containers, various "piggyback" assemblies, and multitudes of paper and cardboard articles have been known and used for scores of years, but because the achievement is not what is or has been suggested to those of ordinary skill in the art, especially realistically considering this as a novel combination comprising components which individually are similar in nature to what is well known to most all persons, surely including most of the many makers and users of throwaway containers for an untold number of years, throughout the entire world. No prior art component or element has even suggested the modifications of any other prior art to achieve the particulars of the novel concepts of the overall combination here achieved, with the special advantages which the overall combination article provides; and this lack of suggestion by any prior art has been in spite of the long world wide use of various types of throwaway containers and the joint use of catsup as a condiment supplement.

The differences of concept and construction as specified herein yield advantages ever the prior art; and the lack of this invention by the prior art, as a prior art combination, has been in spite of this invention's apparent simplicity of the construction once the concepts have been conceived, in spite of the advantages it would have given, and in spite of the availability of all the materials, to all persons of the entire world, and the invention's non-technical and openly-visible nature.

Quite certainly this particular combination of prior art details as here presented in this overall combination has not been suggested by the prior art, this achievement in its particular details and utility being a substantial and advantageous departure from prior art, even though the prior art has had similar components in a separate state for a multiplicity of uses for numbers of years. And particularly is the overall difference from the prior art significant when the non-obviousness is viewed by a consideration of the subject matter of this overall device as a whole, as a combination integrally incorporating features different in their combination from the prior art, in contrast to merely separate details themselves, and further in view of the prior art of throw-away container concepts and articles not achieving particular advantages here achieved by this combination.

Accordingly, it will thus be seen from the foregoing description of the invention according to these illustrative embodiments, considered with the accompanying drawings, that the present invention provides new and useful concepts of a novel and advantageous article, possessing and yielding desired advantages and characteristics in formation and use, and accomplishing the intended objects, including those hereinbefore pointed out and others which are inherent in the invention.

Modifications and variations may be effected without departing from the scope of the novel concepts of the invention; accordingly, the invention is not limited to the specific embodiments, or form or arrangement of parts herein described or shown.

I claim:

1. A basket providing a container for a primary substance and an associated condiment substance, the basket having a generally upright wall panel, and providing an exterior pocket means for holding the associated condiment substance, the exterior pocket means comprising, in combination, an auxiliary wall, support means connected to the auxiliary wall, and supported by the wall panel, providing support by the wall panel to the auxiliary wall in a manner providing that (a.) the auxiliary wall is supported in a first position in which it is generally juxtaposed along the wall panel, and outwardly thereof; and (b.) the auxiliary wall is also supported in a second position in which it is in a substantially horizontal position outwardly away from the first position, although the bottom of the auxiliary wall is still relatively adjacent the wall panel, the support means being of a nature in which it has a collapsed condition of substantially zero extent either inwardly or outwardly of the wall panel, by which it does not force the auxiliary wall to be at any significant distance from the wall panel, but also is changeable to an extended position permitting the auxiliary wall to move outwardly to its said second position, the auxiliary wall in its said second position providing a support for a container of an associated condiment substance, with the auxiliary wall and the exterior pocket means and the condiment container retained thereby being outwardly of the basket and outwardly of the basket's said wall panel.

2. A basket according to claim 1, in which the support means has a vertical nature such that when the auxiliary wall is in its said second position, (a.) the support means provides side walls for the region above the auxiliary wall, and (b.) the support means and the auxiliary wall provide the exterior pocket means as an operable pocket having (c.) a first condition, when the auxiliary wall is in its first position, in which condition the pocket means poses significantly no deterrence to what is provided to be a stackable feature of a plurality of such baskets, (d.) and having a second condition, in which the auxiliary wall panel is in its second position, providing the pocket means to be exteriorly of the basket, and in an open condition for reception of condiment and access to the condiment.

3. A basket according to claim 1, in which the support means is of an accordion-fold nature.

4. A basket according to claim 2, in which the support means is of an accordion-fold nature.

5. A basket according to claim 1, in which the wall panel is provided with a spaced pair of openings extending through the wall panel, the support means comprising a spaced pair of support arms, each having a relatively outer arm portion, a relatively inner arm portion, and an intermediate arm portion respectively extending between the respective relatively outer arm portion and the relatively inner arm portion, (a.) the outer portions of the support arms being positioned relatively adjacent the sides of the auxiliary wall, and (b.) the relatively inner portions of the support arms being positioned inwardly of the basket wall panel, (c.) the intermediate arm portions passing through the respective openings, and the wall panel provided with guide means which are operative, when the auxiliary wall is in its position juxtaposed along the wall panel, to abut the support arms and push them such that they are disposed in a condition generally juxtaposed along the inner face of the wall panel, posing significantly no deference to what is provided to be a stackable feature of a plurality of such baskets.

6. A basket according to claim 5, in which the guide means are provided by a body member affixed to the inner face of the wall panel.

7. A basket according to claim 6, in which a single guide means provides the guide abutment of both support arms, by extending along the wall panel operatively to the location of both of said pair of openings.

8. A basket according to claim 1, in which the support for the auxiliary wall in its said second position is such that the auxiliary wall then provides a bottom wall of the exterior pocket means, upon which may be seated a container of condiment.

9. A basket according to claim 1, in which the auxiliary wall is mounted at a low location on the basket's wall panel.

10. A basket according to claim 1, in which the auxiliary wall is mounted at a location on the basket's wall panel substantially spaced from the top of the basket's wall panel.

11. A basket according to claim 1, in which the support means provides that the top of the auxiliary wall, when the auxiliary wall is in its said second position, is substantially removed from the basket's wall panel.

12. A basket according to claim 1, in which the auxiliary wall and the exterior pocket means provide a substantial seating area for a condiment container.

13. A basket providing a container for a primary substance and an associated condiment substance, the basket having a generally upright wall panel, and providing an exterior pocket means for holding the associated condiment substance, the exterior pocket means comprising, in combination, an auxiliary wall, support means connected to the auxiliary wall, and supported by the wall panel, providing support by the wall panel to the auxilliary wall in a manner providing that (a.) the auxiliary wall is supported in a first position in which it is generally juxtaposed along the wall panel, and outwardly thereof; and (b.) the auxiliary wall is also supported in a second position in which it is in a substantially horizontal position outwardly away from the first position, providing a bottom wall of the exterior pocket means, the support means being of a nature in which it has a collapsed condition of substantially zero extent either inwardly or outwardly of the wall panel, by which it does not force the auxiliary wall to be at any significant distance from the wall panel, but also is changeable to an extended position permitting the auxiliary wall to move outwardly to its said second position, the auxiliary wall in its said second position providing a support for a container of an associated condiment substance, with the auxiliary wall and the exterior pocket means and the condiment container retained thereby being outwardly of the basket and outwardly of the basket's said wall panel.

14. A basket according to claim 13, in which the support means has a vertical nature such that when the auxiliary wall is in its said second position, (a.) the support means provides side walls for the region above the auxiliary wall, and (b.) the support means and the auxiliary wall provide the exterior pocket means as an operable pocket having (c.) a first condition, when the auxiliary wall is in its first position, in which condition the pocket poses significantly no deterrence to what is provided to be a stackable feature of a plurality of such baskets, (d.) and having a second condition, in which the auxiliary wall panel is in its second position, providing the pocket means to be exteriorly of the basket, and in an open condition for reception of condiment and access to the condiment.

15. A basket according to claim 13, in which the support means is of an accordion-fold nature.

16. A basket according to claim 14, in which the support means is of an accordion-fold nature.

17. A basket according to claim 13, in which the wall panel is provided with a spaced pair of openings extending through the wall panel, the support means comprising a spaced pair of support arms, each having a relatively outer arm portion, a relatively inner arm portion, and an intermediate arm portion respectively extending between the respective relatively outer arm portion and the relatively inner arm portion, (a.) the outer portions of the support arms being positioned relatively adjacent the sides of the auxiliary wall, and (b.) the relatively inner portions of the support arms being positioned inwardly of the basket wall panel, (c.) the intermediate arm portions passing through the respective openings, and the wall panel provided with guide means which are operative, when the auxiliary wall is in its position juxtaposed along the wall panel, to abut the support arms and push them such that they are disposed in a condition generally juxtaposed along the inner face of the wall panel, posing significantly no deterrence to what is provided to be a stackable feature of a plurality of such baskets.

18. A basket according to claim 17, in which the guide means are provided by a body member affixed to the inner face of the wall panel.

19. A basket according to claim 18, in which a single guide means provides the guide abutment of both support arms, by extending along the wall panel operatively to the location of both of said pair of openings.

20. A basket according to claim 13, in which the auxiliary wall is mounted at a low location on the basket's wall panel.

21. A basket according to claim 13, in which the auxiliary wall is mounted at a location on the basket's wall panel substantially spaced from the top of the basket's wall panel.

22. A basket according to claim 13, in which the support means provides that the top of the auxiliary wall, when the auxiliary wall is in its said second position, is substantially removed from the basket's wall panel.

23. A basket according to claim 13, in which the auxiliary wall and the exterior pocket means provide a substantial seating area for a condiment container.

* * * * *